United States Patent [19]

Barbier et al.

[11] Patent Number: 4,889,504

[45] Date of Patent: Dec. 26, 1989

[54] ELECTRIC COUPLING DEVICE, A CIRCUIT-BREAKER EQUIPPED THEREWITH AND A RELATED ASSEMBLY OF COMPONENTS

[75] Inventors: René Barbier, Quetigny; Serge Guenin, Talent, both of France

[73] Assignee: La Telemecanique Electrique, Nanterre Cedex, France

[21] Appl. No.: 239,385

[22] Filed: Sep. 1, 1988

[30] Foreign Application Priority Data

Sep. 11, 1987 [FR] France ..... 87 12609

[51] Int. Cl.[4] ..... H01R 9/24; H01R 13/502

[52] U.S. Cl. ..... 439/712; 439/718

[58] Field of Search ..... 439/712, 713, 715, 718, 439/724, 701, 752

[56] References Cited

U.S. PATENT DOCUMENTS

| | | | |
|---|---|---|---|
| 2,727,965 | 12/1955 | Toth et al. | 439/718 |
| 4,056,301 | 11/1977 | Norden . | |
| 4,505,533 | 3/1985 | Nicolaisen | 439/712 |
| 4,790,770 | 12/1988 | Klaiber | 439/715 |

FOREIGN PATENT DOCUMENTS

| | | | |
|---|---|---|---|
| 68925 | 1/1983 | European Pat. Off. | 439/718 |
| 2514206 | 10/1976 | Fed. Rep. of Germany . | |
| 3442625 | 5/1986 | Fed. Rep. of Germany . | |
| 462914 | 11/1968 | Switzerland | 439/715 |

*Primary Examiner*—Gary F. Paumen

*Attorney, Agent, or Firm*—Young & Thompson

[57] ABSTRACT

In an electric coupling device for covering two ranges of current intensities with one and the same casing, each terminal has a stationary conductive strip (28) and a movable yoke (48) which are mounted within a housing of the casing so as to clamp a conductor (51). The housing can also accommodate a more bulky cage-type connector. In order to guide the movable components (42, 48) of the yoke connector and the conductor (51) at the time of introduction, an adapter (52) is fitted within the housing. The adapter surrounds the yoke connector so as to close the clamping zone laterally between the conductive strip (28) and the yoke (48) and to prevent rotation of the yoke. An abutment face (61) limits the relative spacing of the yoke (48) and the strip (28) while a well (59) guides the screw head. A masking panel (71) of the adapter limits the size of the opening (17) to the strict minimum required for introduction of the conductor.

14 Claims, 4 Drawing Sheets

FIG. 3
PRIOR ART
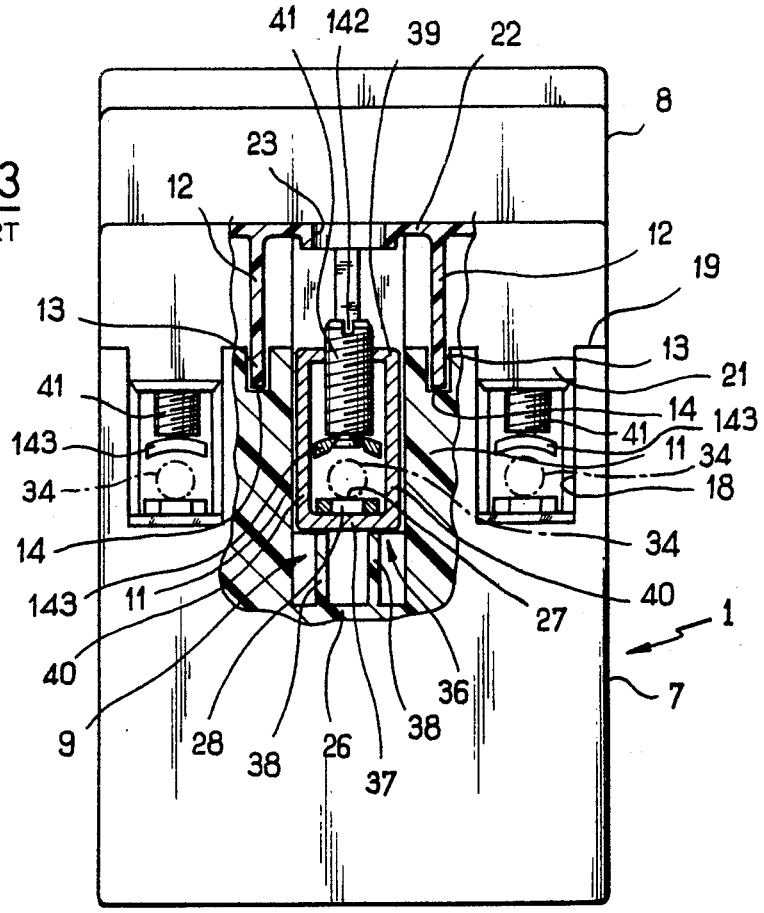
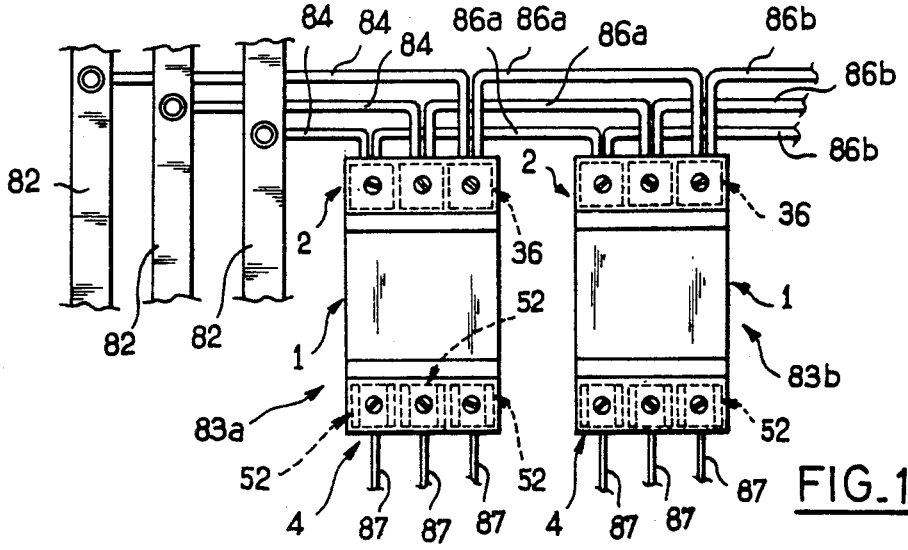
FIG. 11

ELECTRIC COUPLING DEVICE, A CIRCUIT-BREAKER EQUIPPED THEREWITH AND A RELATED ASSEMBLY OF COMPONENTS

BACKGROUND OF THE INVENTION

1. Field of the Invention

The present invention relates to an electric coupling device for the terminal of an electric equipment unit.

This invention further relates to a circuitbreaker equipped with said device.

This invention is also concerned with an assembly of components for the manufacture of electric equipment units.

2. Description of the Prior Art

Certain types of electrical apparatus, in particular those equipped with overload relays such as circuit-breakers, pass currents having a value which is equal at most to that of the maximum adjustment current of the relay.

In order to adjust the maximum adjustment current of the relay as closely as possible to the current presumed to be absorbed by the receiver, manufacturers offer, for an equipment unit having a given rating, a range of current-overload relays in which the maximum adjustment values extend from a very low current value to the rated value of the apparatus. For obvious economic reasons, the electrical fitter will choose the section of coupling conductors as a function of the rating of the relay employed. The equipment unit or apparatus must consequently be provided with connection means which are suited for all cross-sections of conductors corresponding to current intensities within the range for which the apparatus is designed.

In practice, the connection means which ensure high quality of clamping of large-section conductors are liable to damage small-section conductors. It is therefore necessary to adapt the size or the type of connection means as a function of the cross-section of the conductor and consequently of the rating of the overcurrent relay employed.

It is possible for example to employ a connection device of the yoke type for one range of cross-sections of coupling conductors and a connection device of the cage type for another range.

In the yoke-type connection device, the wire is gripped between a movable gripping member or so-called yoke loosely mounted beneath the head of a screw which passes through the yoke, and a fixed gripping member having an internally-threaded bore in which the screw can be engaged so as to clamp the conductor between the two gripping members on either of the two sides of the screw. The stationary gripping member is usually a conductive strip connected to the electrical means contained within the equipment unit.

In the cage-type connection device, a screw can be engaged in an internally-threaded bore of the top of an annular cage of rectangular shape and carries at its free end located within the cage a loosely mounted gripping member having the function of clamping the conductor against a stationary gripping member which is applied against the inner face of the base of the cage.

The cage device is unsuitable for small-section conductors because these latter would be positioned in an uncertain manner between the stationary and movable gripping members and also because the developed clamping force would subject them to excessive stress. On the other hand, the yoke devices are unsuitable for large-section conductors since the available space on each side of the screw is unsufficient to introduce them.

Thus, although it may be postulated that two identical casings may contain electrical means such as an overcurrent relay which are adapted to very different current values such as 1 A and 80 A, for example, this possibility has been abandoned up to the present time since it has been found necessary to provide different casings as a function of the intended coupling so as to make them capable of housing connection devices of the cage or yoke type respectively. The cage devices are more cumbersome than the yoke devices. If it were desired to mount a yoke device within a housing provided within the casing for receiving a cage device, the movable gripping member would not be prevented from rotating by the walls of the housing and the wire to be gripped might be introduced at too great a lateral distance from the screw out of reach of the yoke, thus resulting in a faulty connection.

In point of fact, the need to provide two different casings for the two ranges of cross-sections of conductors produces a significant increase in the cost price of electrical apparatus.

SUMMARY OF THE INVENTION

The object of the invention is thus to propose an electric coupling device which makes it possible to cover both ranges of cross-sections of conductors with identical casings.

The invention is accordingly directed to an electric coupling device for the terminal of an electric equipment unit, which is intended to removably couple an electric cable conductor with a conductive surface of said unit, said coupling device being provided with a housing formed within a casing of the equipment unit and adapted to communicate with the exterior of the casing through an opening for introduction of the cable conductor and through an opening for introduction of a screwdriver or the like, a stationary gripping member which carries the conductive surface and a movable gripping member, said gripping members being drawn towards each other by clamping means which can be actuated by the screwdriver or the like.

In accordance with the invention, the electric coupling device is distinguished by the fact that an adapter is fitted substantially without play within the housing, said adapter being provided with a cavity in which the gripping members are positioned and in which the movable gripping member is guided, said adapter being also provided with openings opposite to the openings of the housing.

Thus, irrespective of the size of the housing provided within the casing, the adapter provides the connection device with a cavity which is perfectly adapted to its dimensions.

In the foregoing as well as in the following description, the term "connection device" is used to designate the means for clamping the conductor against a contact surface and the term "coupling device" is used to designate the assembly in a broader sense which includes the connection device and its functional environment when it is mounted within the casing.

At the time of construction of an electric equipment unit designed for high current values and therefore for the use of large-section conductors, high-rating connection devices are placed directly within the housings of the casing whereas, at the time of construction of an electric equipment unit for low current values and therefore for the use of small-section conductors, coupling devices in accordance with the invention are accordingly arranged within the housings of the casing.

The invention is also directed to a circuit-breaker comprising a series of input terminals and a series of output terminals, as distinguished by the fact that the terminals of at least one of the series are each equipped with a device in accordance with the first aspect of the invention.

In the majority of instances, the input and output terminals are equipped with the same coupling devices. However, in certain particular applications, the output terminals, for example, will alone be equipped with the device in accordance with the invention while the input terminals are equipped with coupling devices of the cage type, for example, for wires of larger cross-sectional area.

The invention also relates to an assembly of components for the manufacture of electric equipment units comprising casings which are all identical and in which housings are defined, said housings being adapted to communicate with the exterior of said casings through an opening for introduction of a cable conductor and through an opening for introduction of a screwdriver or the like, and first clamping connection devices for clamping conductors of relatively large diameter, said devices being capable of fitting within said housings substantially without play, as distinguished by the fact that said assembly also comprises second clamping connection devices for clamping conductors of relatively small diameter, and adapters which are capable of fitting within the housings substantially without play and have a cavity adapted to receive and to guide the second clamping connection devices, said cavity being provided with openings positioned so as to be located opposite to openings of the housings when the adapters are fully engaged within the housings.

BRIEF DESCRIPTION OF THE DRAWINGS

FIG. 3 is an end view of the circuit-breaker of FIGS. 1 and 2 and shows in cross-section one of the cage-type coupling devices.

FIG. 11 is a schematic view of an installation comprising circuit-breakers, the input terminals of which are adapted to receive wires of relatively large cross-section and the output terminals of which receive wires of relatively small cross-section.

DETAILED DESCRIPTION OF THE INVENTION

In the example illustrated in the figures, the circuit-breaker has a casing 1 of generally parallelepipedal shape and three input terminals 2 adjacent to one end face 6 of the casing, and three output terminals 4 adjacent to the other end face 6 of the casing which is opposite to the first.

Figure 1:
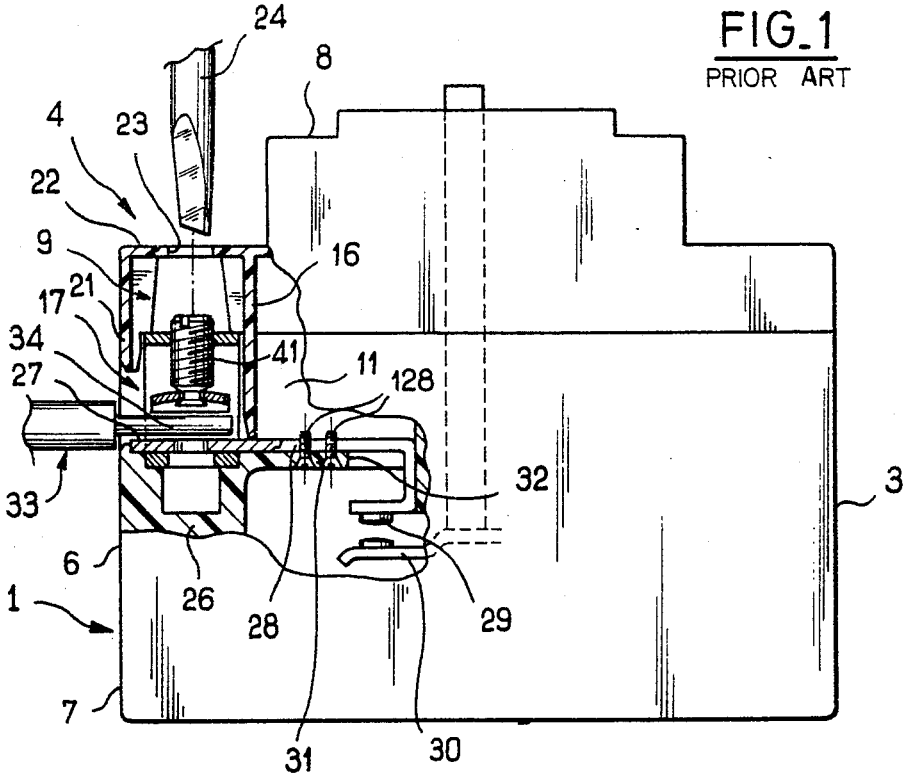
FIG 1 PRIOR ART
FIG. 1 is a view in side elevation showing a circuit-breaker having terminals equipped with cage-type coupling devices, one of which is illustrated in cross-section.

As shown in FIGS. 1 and 3, the casing 1 has a body 7 and a detachable cover 8 which define together in the case of each terminal 2 or 4 a housing 9 which is separated from the other housings by thick partition-walls 11 of the body 7 and by thinner partition-walls 12 of the cover 8. The free ends 13 of the partition-walls 12 are intended to engage in grooves 14 of the partition-walls 11 in order to lengthen the arcing distance.

Each housing 9 is closed at the rear (or in other words on the side remote from the face 6) by means of a partition-wall 16 carried by the cover 8 in the direction of the body 7. As shown in FIGS. 1 and 3, each partition-wall 16 has a region which extends substantially without play between the two partition-walls 11 of the associated housing.

The casing 1 defines for each housing 9 an opening 17 through which said housing communicates with the exterior. To this end, the body 7 of the casing 1 is provided in the case of each housing 9 with a rectangular recess 18 in the edge 19 which forms a joint with the cover 8. The cover 8 is provided in the case of each recess 18 of the body 7 with a tongue 21 which has the same width as the recess 18 and partially closes this latter, each opening 17 being thus defined conjointly by a recess 18 and an associated tongue 21.

The top of each housing 9 is defined by a top wall 22 of the cover 8. The wall 22 is provided in the case of each housing 9 with a circular opening 23 through which said housing 9 communicates with the exterior so as to permit the introduction of a screwdriver 24 or the like (as shown in FIG. 1).

Finally, each housing 9 is closed at the bottom by a wall 26 of the body 7.

The equipment unit is provided in the case of each terminal 2 or 4 with an electric contact surface 27 carried by a conductive strip 28 which is connected to the means contained in the unit.

In the example shown, the conductive strip 28, at the end remote from the contact surface 27, is bent-back twice at 90°. The end of said strip is adapted to carry a contact stud 29 located opposite to a contact bridge 30 which is capable of moving between an open position of the circuit shown in FIG. 1 and a closed position. In this closed position, the contact bridge 30 which is applied against the contact 29 and against a similar contact associated with an output terminal 4 establishes a short-circuit between the two terminals. A contact bridge such as the bridge 30 is provided for each pair of terminals 2, 4.

Each contact strip 28 is fixed by means of two screws 128 on a flange 31 of the wall 26. At that end which is directed towards the interior of the equipment unit, the flange 31 is recessed at 32 so as to permit engagement of the doubly-bent end portion of the conductive strip 28 at the time of assembly.

In order to connect the equipment unit to a power supply system or to an external installation, an electric contact has to be established between each contact surface 27 and a cable conductor 33, one bared end 34 of which is introduced through the opening 17 and applied on the contact surface 27.

Figure 2:
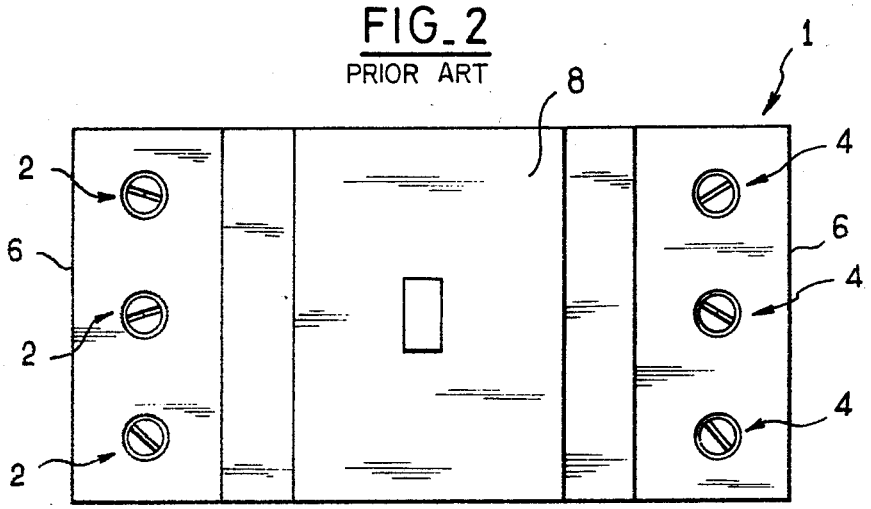
FIG 2 PRIOR ART
FIG. 2 is a top view of the circuit-breaker of FIG. 1.

In the example considered in FIGS. 1 to 3 of a circuit-breaker for currents within the range, for example, of approximately 25 to 80 amps, the cable conductors 33 being therefore of large cross-section, each housing 9 is accordingly provided with a cage-type connection device constituted by an annular cage 36 having a substantially parallelepipedal external shape (as shown in FIG. 3), a bottom end-wall 37 of which rests on the free end of two ribs 38 of the wall 26. The bottom end-wall 37 is therefore interposed between the ribs 38 and the contact strip 28.

The cage 36 is provided in addition with two lateral walls 40, each wall being applied against one of the partition-walls 11 of the casing body 7.

The cage 36 is closed by a head wall 39 located substantially in the joint plane between body 7 and cover 8 of the casing 1. Opposite to the screwdriver-introduction opening 23, the head wall 39 is traversed by an internally-threaded bore in which is engaged a clamping screw 41, the head 142 of which is directed towards the opening 23. A gripping member 143 is attached to that end of the screw 41 which is located within the cage 36, by means of an upset stud which permits relative rotation between the screw 41 and the movable gripping member 143. The gripping member 143 located opposite to the contact surface 27 of the conductive strip 28 which constitutes a stationary gripping member has a generally square shape while being slightly curved in the plane of FIG. 3 at right angle to the direction of introduction of the conductor 33. The sides of said square have a length such that the lateral walls 40 of the cage prevent rotation of the movable gripping member 143 about the axis of the screw 41.

Thus at the time of assembly, when the cover 8 is separated from the body 7 of the casing 1, a contact strip 28 is engaged between the bottom end-wall 37 of a cage 36 and the gripping member 143 carried by the screw 41 which is associated with said cage. Said strip 28 is placed in position within the body 7 while the cage 36 and the screw 41 are placed at the same time within the associated housing 9. This operation is repeated at each of the terminals 2 and 4.

Assuming that the other stages of construction of the equipment unit have been completed, the cover 8 is closed.

At the time of insertion of the circuit-breaker in an installation, the screw 41 of each cage connector having been slackened-off, the bared end 34 of a conductor 33 is engaged within each opening 17 between the contact strip 28 and the movable gripping member 143 until it is abuttingly applied against the partition-wall 16, whereupon a screwdriver 24 is engaged through the opening 23 and the screw 41 is then tightened.

Figure 5:
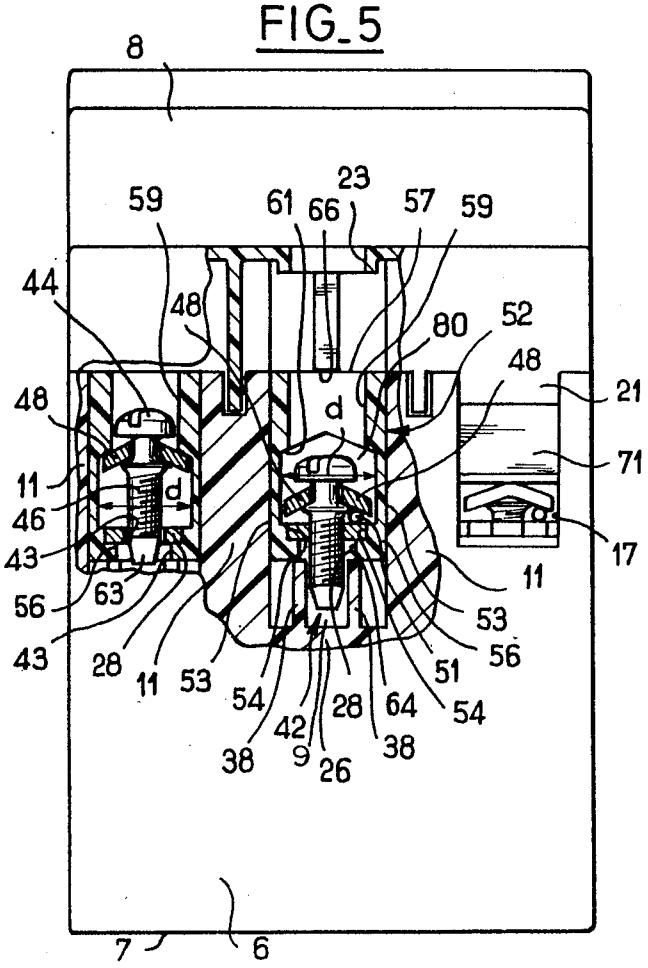
FIG. 5 is an end view of the circuit-breaker of FIG. 4 with a cross-section of two coupling devices in accordance with the invention, as shown in two different positions.
Figure 4:
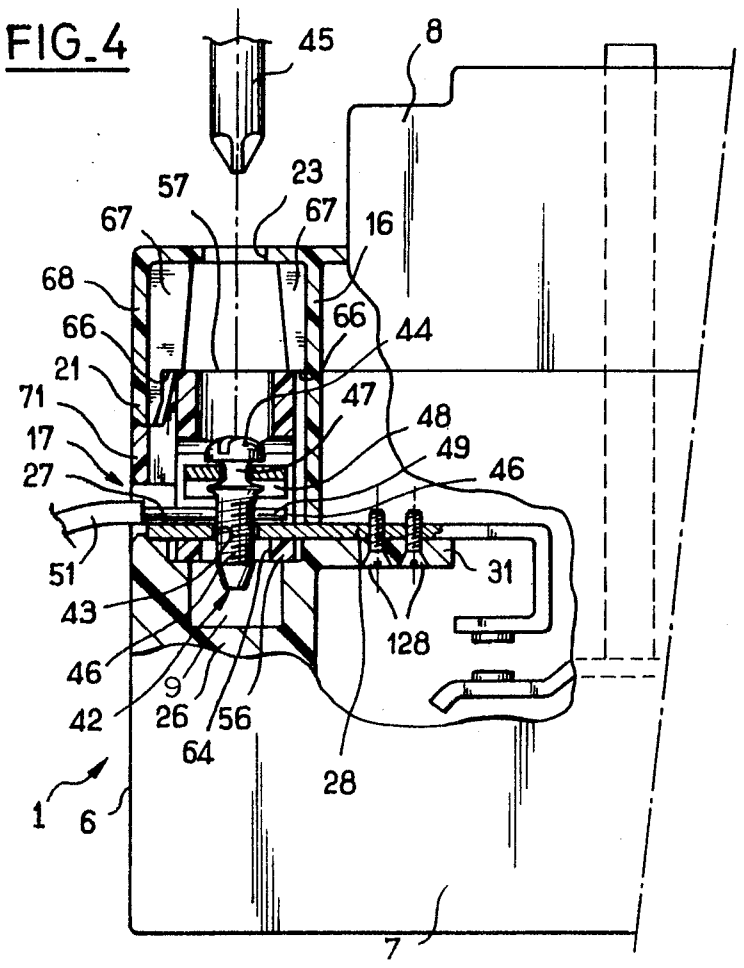
FIG. 4 is a partial view to a larger scale showing a circuit-breaker in accordance with the invention, which is provided with the same casing as the circuit-breaker of FIGS. 1 to 3, and which is equipped with yoke-type coupling devices in accordance with the invention, one of these devices being shown in cross-section.

In the example shown in FIGS. 4 and 5, the same casing 1 having a body 7 and a cover 8 is employed for the construction of a circuit-breaker for maximum current intensities of 25 amps, for example, with conductors of small cross-section. The contact strips 28 are also the same as those of FIGS. 1 to 3. The connection device is of the yoke type and comprises more particularly a screw 42 which is engaged by screwing in an internally-threaded bore 43 of the contact strip 28 and the head 44 of which is directed towards the opening 23 so as to be accessible through this latter by means of a screwdriver 45.

Between its head 44 and its threaded region 46, the screw 42 has a necked portion 47 for a movable gripping member 48 which is held captive around said necked portion and has a generally square shape, said gripping member being curved inwards in the plane perpendicular to the direction of introduction of the bared end 49 of a small cable conductor 51.

Thus, when a conductor 49 has been introduced through the opening 17 and the screw 42 is tightened by means of the screwdriver 45, it is possible in known manner to bring the movable gripping member 48 towards the contact strip 28 which constitutes the stationary gripping member so as to clamp the bared end 49 between the stationary gripping member 28 and the movable gripping member 48.

The dimension of each side of the square movable gripping member 48 is distinctly smaller than the distance between the successive partition-walls 11 of the casing body 7. Thus if no other arrangements are contemplated, it is possible on the one hand that the bared end 49 may be introduced too far from the screw 42 out of reach of the movable gripping member 48 and probable on the other hand that the movable gripping member 48 will be displaced in rotation by the screw 42 and will not be in the correct angular position to clamp the bared end 49 when the screw is tightened hard up.

In accordance with the invention, in order to overcome these disadvantages, an adapter 52 (shown alone in FIGS. 6 and 7) of molded plastic having the general shape of a hollow parallelepiped with the same external dimensions as the cage 36 is mounted within each housing 9 of the apparatus for relatively low current intensities. The adapter 52 is provided on each side of a cavity 80 with two lateral wings 53 which are substantially parallel to the direction of introduction of the conductor 51 through the opening 17. The lateral wings 53 extend on each side of the movable gripping member 48 and of the stationary gripping member 28, each wing being placed against the adjacent wall 11.

The free distance d between the lateral wings 53 is slightly greater than the corresponding dimension of the movable gripping member 48 in order to ensure that this latter is capable of sliding between the wings 53 but is prevented from rotating between them about the axis of the screw 42.

In the vicinity of their base, the wings 53 are provided with overthicknesses directed towards each other so as to have faces 54 adjacent to the lateral edges of the contact strip 28. Thus each lateral wing 53 closes one side of a gripping zone located between the stationary gripping member 28 and movable gripping member 48.

The two lateral wings 53 which are substantially parallel to the direction of introduction of the conductor 51 through the opening 17 are joined to each other by spacing means constituted on each side of the cavity 80 by an adapter end-wall 56 (see FIGS. 4, 6 and 7 and the left portion of FIG. 5) and an adapter head 57. The adapter end-wall 56 extends opposite to that external face of the stationary gripping member 28 which is remote from the gripping zone and the adapter head 57 extends opposite to the external face of the movable gripping member 48, this face being also remote from the gripping zone.

The adapter head 57 is traversed by a well 59 which extends along the axis of the screw 42 between this latter and the orifice 23 so that the screwdriver 45 is thus permitted to reach the screw head 44 through the orifice 23 and the well 59.

As shown in the left portion of FIG. 5, the well 59 also has the function of guiding the screw head 44 when the stationary gripping member 28 and movable gripping member 48 are located in the vicinity of their maximum distance from each other.

The adapter head 57 is provided on the side adjacent to the cavity 80 with an abutment face 61 which, when looking in the direction of introduction of the conductor 51 (FIG. 5), has a vault-shaped profile which is applied in substantially mating contact with the profile of the movable gripping member 48 when this latter is in its position of maximum spacing with respect to the stationary gripping member 28 while the screw head 44 is engaged within the well 59 (see left portion of FIG. 5).

Thus the face 61 limits the relative spacing of the two gripping members 28, 48.

When the movable gripping member 48 is applied against the face 61, the threaded region 46 (see left portion of FIG. 5) of the screw 42 is withdrawn from the threaded bore 43 of the contact strip 28. On the other hand, the tapered tip 63 of the screw is still engaged within the internally-threaded bore 43, with the result that the yoke-type connection device 28, 42, 48 is entirely imprisoned within the adapter and remains in readiness for re-tightening without any need for preliminary repositioning.

Steps being taken to ensure that only the tip 63 of the screw 42 is still engaged in the bore 43 of the contact strip 28 when the movable gripping member 48 is in the position of maximum spacing, the screw is given the smallest possible length in order to allow both a given maximum spacing between the gripping members 28, 48 and to perform the function of retention of the screw 42 in the position of maximum spacing.

It is an advantage to reduce the length of the screw in order to reduce the screwing time when carrying out cable-connecting operations and also in order to reduce the extent of projection of the screw beneath the contact strip 28 when the bared end 49 is clamped between the gripping members 28, 48 (see central portion of FIG. 5). The projecting portion of the screw is received between the two ribs 38 which extend from the bottom end-wall 26 of the housing 9.

The projecting portion of the screw 42 is also engaged within an opening 64 formed through the end-wall 56 of the adapter. The end-wall 56 rests on the ribs 38. The opening 64 has a diameter which is larger than that of the stem of the screw 42.

The adapter 52 is positioned between the ribs 38 on which its end-wall 56 is applied and shouldered portions 66 carried by internal ribs 67 of the cover 8. Said ribs are adjacent respectively to the partition-wall 16 associated with the housing 9 considered and to a cover wall 68 which serves to define the end face 6 of the casing 1. The shouldered portions 66 are directed towards the body 7 and located substantially in the joint plane between body 7 and cover 8.

The position of the adapter 52 in the direction of introduction of the conductor 51 is defined between the partition-wall 16 of the housing 9 considered and the rib 67 which extends beyond the shouldered portion 66 behind the tongue 21.

The adapter 52 which is mounted within a housing 9 considered is positioned with respect to lateral displacements by means of the two partition-walls 11 which are adjacent to said housing. Thus the volume left free by the cage 36 is perfectly occupied by said adapter 52. As in the assembly shown in FIGS. 1 to 3, the contact strip 28 is fixed by means of the two screws 128 on the flange 31 of the wall 26 which forms part of the body 7 of the casing 1.

Thus the contact strip 28 and the adapter 52 serve to position the screw 42 and the movable gripping member 48.

Figure 6:
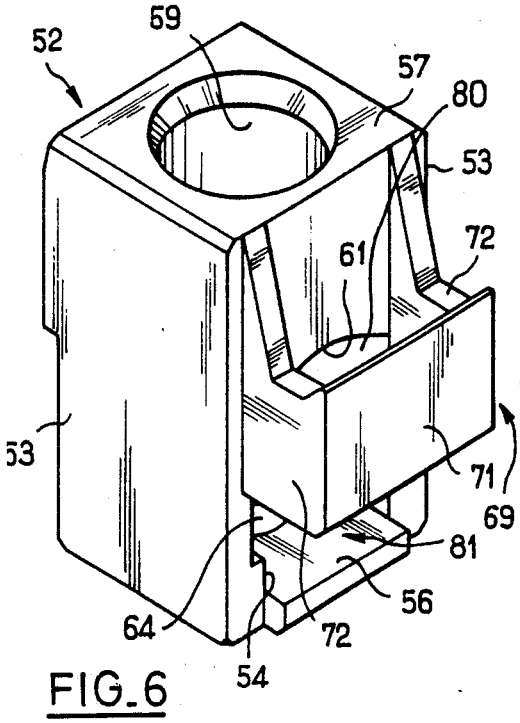
FIG. 6 is a view in perspective of the adapter.
Figure 7:
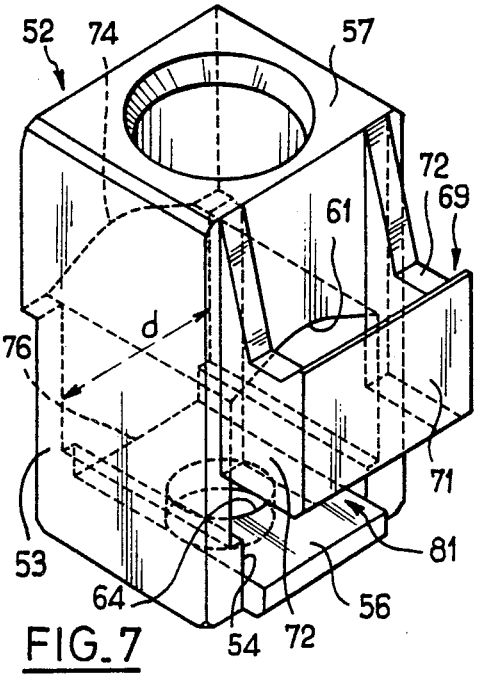
FIG. 7 is a view which is similar to FIG. 6 but with dashed lines for visualizing the concealed edges.

The adapter is provided in addition with a projecting portion 69 comprising a front panel 71 (FIGS. 4, 6, 7) of rectangular shape, the two mutually remote edges of which are joined to the wings 53 by two bearing wings 72 located substantially in the line of extension of the wings 53. The panel 71 partially closes the opening 17 and, more particularly, closes approximately one-half of the opening 17, namely that half which is adjacent to the tongue 21 of the cover and which is consequently farthest away from the contact surface 27. It is thus ensured that, at the time of wiring, introduction of the conductor 51 takes place systematically close to said contact surface through an opening 81 formed in the adapter between the panel 71 and the end-wall 56 (as shown in FIGS. 6 and 7).

Figure 8:
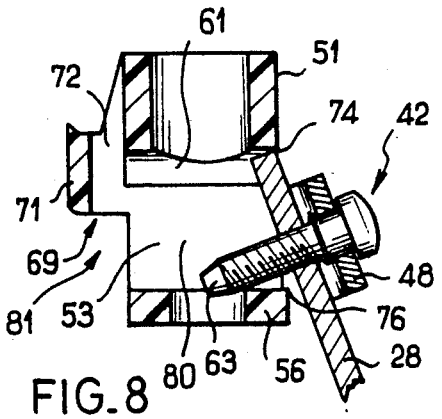
FIGS. 8 and 9 are two sectional views of the adapter, of the gripping members and of the screw at the time of assembly.

As shown in FIG. 8, the initial step of the assembly operation consists in assembling a contact strip 28, a screw 42 and a movable gripping member 48, the screw 42 being screwed practically hard up in order to bring the gripping members 28 and 48 together to the maximum extent. It is only in this position of minimum or practically minimum spacing of the gripping members that the yoke-type connection device is detachable with respect to the adapter 52. In order to assemble them together, the tip 63 of the screw is first engaged in a rear opening of the adapter 52 which is remote from the opening 17 in service. The rear opening of the adapter 51 is defined between a free rear edge 74 of the abutment surface 61, a free rear edge of each lateral wing 53 and a free rear edge 76 of the end-wall 56.

Figure 9:
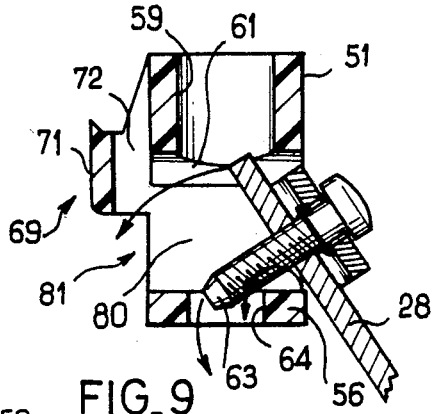

As shown in FIG. 9, the connector is then displaced in a pivoting and sliding movement against the edge 76 so as to engage the tip 63 of the screw within the opening 64 of the end-wall 56 while the contact strip 28 is brought into a flat position against the end-wall 56.

Figure 10:
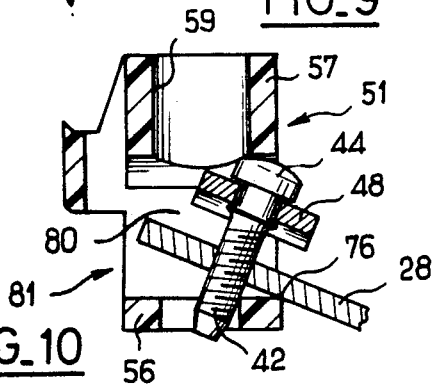
FIG. 10 is a view of the same elements in which their undetachable condition is visualized.

As shown in FIG. 10, if the spacing between the gripping members 28 and 48 is significantly different from the minimum spacing, it is impossible to extract the yoke connector from the adapter 52 since the screw head 44 projects too far from the contact strip 28 in that case and abuts against the head 57 of the adapter 52 at the time of pivoting and sliding displacement about the edge 76. It is readily apparent that, if the spacing between the gripping members 28, 48 is such that the head 44 is already engaged within the well 59 of the head 57, even a beginning of the movement of extraction is made impossible.

Thus the adapter which has just been described produces the following technical effects:

closure of that portion of the opening 17 which is made unnecessary by the removal of the cage whilst the remaining portion permits correct introduction of the conductor beneath the yoke;

guiding of the yoke at the time of clamping;

retention of the adapter 52 by means of its end-wall 56 which is engaged beneath the contact strip 28 and retention of the assembly consisting of screw 42 and yoke 48 by abutting application of the yoke 48 beneath the head 57 of the adapter 52 when the tip of the screw is still engaged within its internally-threaded bore;

resultant undetachability of the different components of the coupling device (except by carrying out in the reverse order the operations described with reference to FIGS. 8 and 9);

ease of assembly.

In the example shown in FIG. 11, three bus bars 82 supply a plurality of circuit-breakers 83*a*, 83*b*, . . . The input of the circuit-breaker 83*b* is not connected directly to the bus bars 82 but is connected by means of bridges 86*a* to the input of the circuit-breaker 83*a*. Other bridges 86*b* connect the input of the circuit-breaker 83*b* to the input of the following circuit-breaker (not shown).

Each circuit-breaker 83*a*, 83*b*, which is so adjusted as to open the circuit when a relatively low maximum current intensity is attained, delivers at its output only a current having at most the maximum intensity in question. This makes it possible to connect small-section conductors 87 to the output of each circuit-breaker 83*a*, 83*b*. To this end, there is placed at the output terminals 4 a coupling device in accordance with the invention comprising an adapter 52 for positioning and guiding a yoke-type connection device.

On the other hand, each input terminal 2 is intended to receive two conductors 84, 86*a* or respectively 86*a*, 86*b*. Moreover, each of these two conductors carries the current to be supplied to all the circuit-breakers located downstream plus, in the case of one of the two conductors, the current to be supplied to the circuit-breaker to which the terminal in question belongs. These conductors must therefore be of relatively large diameter. The connection of two conductors of this type to one and the same terminal makes it necessary to choose a larger connection device, for example of the type comprising a cage 36 without adapter.

In accordance with the invention, the casings 1 of these circuit-breakers 83*a*, 83*b* are identical with the casing of FIGS. 1 to 5, the terminals 2 being equipped with cage-type connection devices 36 and the terminals 4 being equipped with yoke-type connection devices housed within adapters 52.

As will be readily apparent, the invention is not limited to the examples described in the foregoing and illustrated in the accompanying drawings.

By way of example, the adapter could simply be provided with two bottom flanges of the wings 53 instead of the end-wall 56, which would permit assembly of the adapter and connection device simply by withdrawal of the wings 53.

Similarly, the spacing means could be provided only with an end-wall such as the end-wall 56, the head being replaced by suitably shaped extensions of each lateral wing with a view, for example, to guiding the screw and/or limiting the spacing of the yoke with respect to the contact strip.

The connection devices can be of the resilient clamping type in which a movable gripping member is urged by a spring to clamp the conductor against a stationary gripping member.

What is claimed is:

1. An electric coupling device for the terminal (2, 4) of an electric equipment unit, which is intended to removably couple an electric cable conductor (51) with a conductive surface (27) of said unit, said coupling device being provided with a housing (9) formed within a casing (1) of the equipment unit and adapted to communicate with the exterior of the casing through an opening (17) for introduction of the cable conductor 51 and through an opening (23) for introduction of a screwdriver (45), a stationary gripping member (28) which carries the conductive surface (27) and a movable gripping member (48), said gripping members drawn towards each other by clamping means (42) which can be actuated by the screwdriver, wherein an adapter (52) is fitted substantially without play within the housing (9) of the casing (1), said adapter being provided with a cavity in which the gripping members (28, 48) are positioned and in which the movable gripping member (48) is guided, said adapted being also provided with openings (59, 81) opposite to the openings (17, 23) of the housing (9), whereby said adapter allows for positioning in the relatively large housing (9) not only relatively large-sized cables but also relatively small gripping members (38, 48) suitable for relatively small-sized cables.

2. An electric coupling device according to claim 1, in which the stationary gripping member (28) and the movable gripping member (48) define between them a clamping zone opposite to the opening (17) for introduction of the conductor and are transversed by a common clamping screw (42) which is engaged with one (28) of the gripping members by screwing and is engaged in free rotation without any possibility of sliding within the other gripping member (48), wherein the adapter (52) has two lateral wings (53) which are substantially parallel to the direction of introduction of the conductor (51), which extend on each side of the movable gripping member (48), which close the clamping zone laterally and which retain the movable gripping member (48) in opposition to rotational displacements about the axis of the screw (42), said two wings (53) being joined to each other by spacing means (56, 57) extending opposite to an external face of at least one of the gripping members (28, 48), namely the face which is directed away from the clamping zone.

3. A device according to claim 2, wherein the spacing means (56, 57) comprise opposite to the external face of the movable gripping member (48) an adapter head (57) which serves to limit the relative spacing of the two gripping members (28, 48) and is traversed by one (59) of the aforementioned openings for insertion of a screwdriver (45) which is located opposite to the opening (23) for introduction of a screwdriver (45) and provided in the casing (1, 8).

4. A device according to claim 3, wherein the opening (59) for insertion of a screwdriver through the adapter head (57) is so shaped as to form a well for guiding the head (44) of the clamping screw (42).

5. A device according to claim 3, wherein the head (57) of the adapter is provided opposite to the movable gripping member (48) with an abutment face (61) which, looking in the direction of introduction of the conductor (51), has a vault-shaped profile which conforms substantially to the profile of the movable clamping member (48) when this latter is in the position of maximum spacing with respect to the stationary gripping member (28).

6. A device according to claim 5, wherein the internally-threaded bore is carried by the stationary gripping member (28), wherein the stem of the screw (42) has a tapered tip (63) at the end remote from the head (44) of said screw and wherein said tapered tip (63) is engaged in the internally-threaded bore (43) when the movable gripping member (48) is abuttingly applied against the head (57) of the adapter (52).

7. A device according to claim 3, wherein the spacing means include a bottom end-wall (56) of the adapter, said end-wall being adjacent to one face of the stationary gripping member (28) which is remote from the clamping zone, wherein the internally-threaded bore (43) is carried by the stationary gripping member, wherein the subassembly comprising the screw and the two gripping members (28, 48) is engageable within the adapter by pivotal displacement about a free edge (76) of the bottom end-wall (56) when the two gripping members (28, 48) are in the vicinity of a position of maximum relative inward displacement, and wherein abutting application of the screw head (44) against the adapter head (57) prevents disengagement of said subassembly when the relative spacing of the two gripping members (28, 48) exceeds a predetermined threshold value.

8. A device according to claim 7, wherein the adapter (52) forms a rear opening towards the interior of the casing on the side opposite to the opening (17) for introduction of the conductors (51) and said free edge (76) of the bottom end-wall (56) is adjacent to the rear opening.

9. A device according to claim 1, wherein the housing (9) is defined conjointly between a body (7) and a cover (8) of the casing (1) and the adapter is detachably fitted between said body and said cover.

10. A device according to claim 1, wherein the adapter (52) has a projecting portion (69) which is inserted in the opening (17) for introduction of the conductor (51) and partially closes said opening on one side remote from the conductive surface (27) so as to ensure that the conductor (51) is introduced systematically in close proximity to said conductive surface at the time of wiring.

11. A device according to claim 1, wherein the adapter (52) is of plastic material.

12. A circuit-breaker comprising a series of input terminals (2) and a series of output terminals (4), wherein the terminals of at least one of the series (2, 4) are each equipped with a device according to claim 1.

13. A circuit-breaker according to claim 12, wherein the other series of terminals (4) is equipped with connection devices having external dimensions which are substantially the same as those of the adapters (52).

14. An assembly of components for the manufacture of electric equipment units, comprising casings (1) which are all identical and in which housings (9) are defined, said housings being adapted to communicate with the exterior of said casings through an opening (17) for introduction of a cable conductor (34, 51) and through an opening (23) for introduction of a screwdriver (24, 45), and first clamping connection devices (28, 36, 41, 143) for clamping conductors (34) of relatively large diameter, said devices being capable of fitting within said housings substantially without play, wherein said assembly also comprises second clamping connection devices (28, 44, 48) for clamping conductors (51) of relatively small diameter, and adapters (52) which are capable of fitting within the housings (9) substantially without play and which each have a cavity adapted to receive and to guide the second clamping connection devices (28, 44, 48), each said cavity being provided with openings (59, 81) positioned so as to be located opposite to openings (17, 23) of the housings (9) when the adapters (52) are fully engaged within the housings (9).

* * * * *